US010810987B2

(12) United States Patent
Baker

(10) Patent No.: US 10,810,987 B2
(45) Date of Patent: Oct. 20, 2020

(54) MORE EMBODIMENTS FOR COMMON-POINT PICKUP CIRCUITS IN MUSICAL INSTRUMENTS

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 16/840,644

(22) Filed: Apr. 6, 2020

(65) Prior Publication Data

US 2020/0234685 A1 Jul. 23, 2020

Related U.S. Application Data

(63) Continuation-in-part of application No. 16/139,027, filed on Sep. 22, 2018, now Pat. No. 10,380,986, and a continuation-in-part of application No. 15/616,396, filed on Jun. 7, 2017, now Pat. No. 10,217,450, and a continuation-in-part of application No. 14/338,373, filed on Jul. 23, 2014, now Pat. No. 9,401,134.

(60) Provisional application No. 62/835,797, filed on Apr. 18, 2019.

(51) Int. Cl.
*G10H 3/18* (2006.01)
*G10H 1/00* (2006.01)

(52) U.S. Cl.
CPC ..... *G10H 3/181* (2013.01); *G10H 1/0008* (2013.01); *G10H 2220/461* (2013.01)

(58) Field of Classification Search
CPC combination set(s) only.
See application file for complete search history.

(56) References Cited

U.S. PATENT DOCUMENTS 2,026,841 A 1/1936 Lesti
3,249,677 A * 5/1966 Burns ..... G10H 3/182 84/726
3,524,143 A * 8/1970 Munch, Jr. ..... G10H 3/186 330/295
4,024,789 A * 5/1977 Humphrey ..... G09B 15/04 84/477 R
4,151,776 A 5/1979 Stich
(Continued)

OTHER PUBLICATIONS

Baker, DL, https://www.researchgate.net/publication/333203140_Title_of_Invention_Single-Coil_Pickup_with_Reversible_Magnet_Pole_Sensor, Jan. 2019, published version of U.S. Appl. No. 15/917,389 on ReserachGate.net.

(Continued)

*Primary Examiner* — Michael C Zarroli

(57) ABSTRACT

This invention refines and expands the use of mode switches in common-point connection circuits for matched pickups on musical instruments. For example, on a 3-coil S-type electric guitar, where the common-point connection circuit with a single-ended output provides three humbucking pair outputs and three humbucking triple outputs, a 4P2T mode switch can ground the common point and provide both all of the standard non-humbucking 5-way switch outputs, as well as adjusting the tone capacitor to make both humbucking and non-humbucking tone outputs more compatible. On an electric guitar with three dual-coil humbuckers, mode switches of one 6P2T, one 2P2T and three 1P2T can choose between dual-coil and single-coil operation modes, humbucking and non-humbucking modes, and partially simulate the effect of flipping single-coil magnets at will, by choosing which coil of each humbucker is used.

7 Claims, 10 Drawing Sheets

(56) References Cited

U.S. PATENT DOCUMENTS

| | | | | | |
|---|---|---|---|---|---|
| 4,319,510 | A * | 3/1982 | Fender | G10H 3/182 | 84/728 |
| 4,372,187 | A * | 2/1983 | Berg | G10H 1/342 | 84/702 |
| 4,499,809 | A * | 2/1985 | Clevinger | G10H 3/182 | 84/726 |
| 4,545,278 | A | 10/1985 | Gagon | | |
| 5,780,760 | A | 7/1998 | Riboloff | | |
| 6,034,316 | A * | 3/2000 | Hoover | G10H 3/186 | 84/738 |
| 6,271,456 | B1 * | 8/2001 | Nelson | G10H 3/181 | 84/726 |
| 9,401,134 | B2 | 7/2016 | Baker | | |
| 9,747,882 | B1 * | 8/2017 | Micek | G10H 3/182 | |
| 10,217,450 | B2 | 2/2019 | Baker | | |
| 10,380,986 | B2 | 8/2019 | Baker | | |
| 2015/0262568 | A1 * | 9/2015 | Krasnov | G10H 3/181 | 84/728 |
| 2019/0057678 | A1 | 2/2019 | Baker | | |

OTHER PUBLICATIONS

U.S. Appl. No. 16/752,670, Baker, filed Jan. 26, 2020, Modifications to a lipstick-style pickup housing and core to allow phase reversals in humbucking circuits.

U.S. Appl. No. 62/977,462, Baker, filed Feb. 17, 2020, Modular single-coil pickup; -> U.S. Appl. No. 16/812,870. Baker, filed Mar. 9, 2020, Modular single-coil pickup.

* cited by examiner

MORE EMBODIMENTS FOR COMMON-POINT PICKUP CIRCUITS IN MUSICAL INSTRUMENTS

This application claims the benefit of precedence of the following U.S. Patents and Patent Applications: by continuation in part of U.S. Pat. No. 9,401,134 (Baker, 2016 Jul. 26), U.S. Pat. No. 10,217,450 (Baker, 2019 Feb. 26), U.S. Pat. No. 10,380,986 (2019 Aug. 13) and the Provisional Patent Application 62/835,797 (Baker, 2019 Apr. 18); and is in part related to U.S. NonProvisional patent application Ser. No. 15/917,389 (Baker, 2018 Jul. 14), Ser. No. 16/752,670 (Baker, 2020 Jan. 26) and Ser. No. 16/812,970 (Baker, 2020 Mar. 9); by this inventor, Donald L. Baker dba android originals LC, Tulsa Okla. USA

COPYRIGHT AUTHORIZATION

Other than for confidential and/or necessary use inside the Patent and Trademark Office, this authorization is denied until the Nonprovisional Patent Application is published, at which time it may be taken to state:

The entirety of this application, specification, claims, abstract, drawings, tables, formulae etc., is protected by copyright: © 2020 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

APPLICATION PUBLICATION DELAY

Not Applicable—Much of the record of this patent application will also be published on ResearchGate.net at:

https://www.researchgate.net/profile/Donald_Baker2/projects

CROSS-REFERENCE TO RELATED APPLICATIONS

This application is related to the patents and applications cited above for benefit, and discloses additional embodiments especially relating to U.S. Pat. No. 10,380,986 (Baker, 2019 Aug. 13), filed by this inventor, Donald L. Baker dba android originals LC, Tulsa Okla. USA.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

Incorporation-by-Reference of Material Submitted on a Compact Disc or as a Text File Via the Office Electronic Filing System (EFS-WEB)

Not Applicable

STATEMENTS REGARDING PRIOR DISCLOSURES BY THE INVENTOR OR A JOINT INVENTOR

Not Applicable

TECHNICAL FIELD

This invention describes electro-magnetic string vibration pickups, primarily used in guitars and basses, also applicable to other musical instruments with ferrous strings, such a pianos, to be used in humbucking circuit arrangements in which each pickup responds equally to external electromagnetic fields, otherwise known a hum. It can be made to apply to other sensors, such as piezo-electric, hall-effect and strain gage.

REFERENCES

U.S. Pat. No. 2,026,841, Lesti, 1936 Jan. 7, Electric translating device for musical instruments U.S. Pat. No. 4,545,278, Gagon, et al., 1985 Oct. 8, Apparatus and method for adjusting the characteristic sounds of electric guitars, and for controlling tones U.S. Pat. No. 5,780,760, Riboloff, 1998 Jul. 14, Guitar pickup switching system for three-pickup guitar U.S. Pat. No. 4,151,776, Stich, 1979 Apr. 1 Electronic pickup system for stringed musical instrument U.S. Pat. No. 9,401,134, Baker, 2016 Jul. 26, Acoustic-electric stringed instrument with improved body, electric pickup placement, pickup switching and electronic circuit U.S. NPPA Ser. No. 15/917,389, Baker, 2018 Jul. 14, Single-coil pickup with reversible magnet & pole sensor, https://www.researchgate.net/project/US-Patent-App-15-917-389-Single-Coil-Pickup-with-Reversible-Magnet-Pole-Sensor U.S. Pat. No. 10,217,450, Baker, 2019 Feb. 26, Humbucking switching arrangements and methods for stringed instrument pickups US2019/0057679 A1, Baker, 2019 Feb. 21, Means and methods for obtaining humbucking tones from variable gains, NPPA Ser. No. 16/156,609 (Baker, 2018 Oct. 10)

U.S. Pat. No. 10,380,986, Baker, 2019 Aug. 13, Means and methods for switching odd and even numbers of matched pickups to produce all humbucking tones U.S. NPPA Ser. No. 16/752,670, Baker, filed 2020 Jan. 26, Modifications to a lipstick-style pickup housing and core to allow phase reversals in humbucking circuits US PPA 62/977,462, Baker, filed 2020 Feb. 17, Modular single-coil pickup O,Connor, S M, 2016, Patented electric guitar pickups and the creation of modern musical genres, Geo. Mason L. Rev., 23:4(1007-1044)

Baker, Donald L., 2020, Sensor Circuits and Switching for Stringed Instruments, humbucking pairs, triples, quads and beyond, available early 2020, © Springer Nature Switzerland AG 2020, ISBN 978-3-030-23123-1

Software used, FFT; "About: Simple Audio Spectrum Analyzer, SpecAn_3v97c.exe, v. 3.9, © W. A. Speer, 2001-2016, Samples an audio input stream in 16-bit stereo, then uses a Fast Fourier Transform to yield the spectral analysis in real time. Note: for this application definition 0dBFS—digital sinewave of maximum amplitude without clipping. See also http://www.techmind.org/"

BACKGROUND AND PRIOR ART

This inventor was not able to find original patents for the standard 3-way switch commonly used on dual-humbucker electric guitars, or for the common 5-way switch commonly used with electric guitars having 3 single-coil pickups. According to O'Connor (2016, p 1036, citing http://alloutput.com/guitar/5-way-switches-explained/) players found they could balance the 3-way switch of the 3-coil Fender Stratocaster™ (released in 1954) between positions to get sound from two pickups at a time. O'Connor claims that the sounds of the 2-pickup combinations were out-of-phase and weak. If that is so, then at some time later Fender reversed the connections and/or pole on the middle coil to obtain in-phase tones, but his inventor has not been able to find a reference. O'Connor (p 1036) claims that Fender introduced the 5-way switch sometime in the 1970s to 1980s. Gagon et al. (U.S. Pat. No. 4,545,278, 1985) and Riboloff (U.S. Pat. No. 5,780,760, 1998) use the standard 5-way switch and a variant to switch 3 single coils, with all the coils connected by one terminal to ground. But they focus mostly on tone.

Baker (U.S. Pat. No. 9,401,134, 2016) used two 4 pole-5 throw "super-switches" to combine 4 matched single-coil pickups into 4 humbucking pairs, and 1 humbucking quad, with separate switches for series and parallel pickup circuits. Columns 18-19 specifically disclose the nature of humbucking pairs. Ignoring SW1 and SW2, FIGS. 1 & 2 show the basic humbucking pairs, for common electromagnetic guitar pickups, using either a two-coil humbucker or two matched single-coil electromagnetic pickups. The C-triangle symbol designates the common-point connection, as described in U.S. Pat. No. 10,380,986. The coils are connected together so that the hum voltages cancel at the output, Vo1-Vo2. But the magnetic pole the pickup shows to the strings determines the relative phase of the string vibration signal. If the poles are opposite (FIG. 1), the string signals add; if they are the same (FIG. 2) one string signal subtracts from the other.

Seeing that many patented pickups circuits threw switches at the problem without bothering to check for duplicate circuits, Baker (U.S. Ser. No. 10/217,450, 2019, filed 2017 Jun. 7) systematically constructed and enumerated series-parallel single-coil pickups circuits, up to 6 pickups in size (disclosing up to 5), then substituted series and parallel humbucking pairs with matched single-coil pickups for the previously constructed single-coil pickup circuits, disclosing humbucking circuits up to 6 pickups.

Baker also discovered a 3-coil humbucking circuit in U.S. Ser. No. 10/217,450, which became the basis for humbucking circuits of any number of 2 or more of matched single-coil pickups, in a patent application filed 2018 Sep. 22, published as US 2019/0057678A1, 2019 Feb. 21, which became U.S. Pat. No. 10,380,985 (Baker, 2019 Aug. 13). This patent established that there is no need to reverse-wind pickups with reversed magnetic poles, when it is simpler just to reverse the pickup terminals. Humbucking is not affected by the pole orientation of the magnet, but by the connections of the coils. To hum, the magnet is just another magnetically permeable structure.

U.S. Pat. No. 10,380,986 discloses the common-point connection switching system, where all the pickup are connected to a single point by their terminals with the same phase of hum voltage. The other terminals of the pickups are connected either to the high or low output terminal, or no terminal. At least one pickup must be connected to each output terminal. This cancels hum, regardless of the number of pickups (greater than one) connected between the common-point connection and each output terminal. If more than one matched pickup is connected between the common point and an output, then the effective output from those multiple pickups is the average of their signals, the total divided by their number. Either the common-point connection is grounded, or the low output terminal is grounded, but not both. The resulting circuits are all humbucking, but do not include all of the possible humbucking series-parallel circuits of matched single-coil pickups. Nevertheless, this simplifies pickup switching and still provides more combinations that standard 5-way switches. For common-point connection circuits of 2, 3, 4, 5 and 6 matched coils, there are 1, 6, 25, 90 and 301 possible different circuits.

SW1 and SW2 in FIGS. 1 & 2 show basic variations of the common point switching system, as derived from SWa and SWb in FIG. 17 in U.S. Pat. No. 10,380,986 (Baker, 2019). If SW1 is in the center-off position, neither pickup is shorted out and the output is humbucking. If it is up or down, then one pickup (or set of parallel pickups) is shorted and the output is non-humbucking. If SW2 is in the up position, then the common-point connection (C-triangle symbol) is grounded, and the output (Vo1-Vo2) is differential, with both voltages above ground. If SW2 is in the down position, then the lower output, Vo2, is grounded, making Vo1 a single-ended output, as is common with most electric guitars.

We will see from later Figures that SW1 is overkill. For the most common of electric guitar outputs, single-ended with SW2 down, where the lower output is always grounded, SW1 need only have two throws, open and ground. For multiple pickups, allowing SW1 to have three throws only produces a set of outputs for the third throw that are all duplicates. To minimize noise, SW1 should preferably be either open or grounded.

The closest patent this inventor could find that has some features of this invention is U.S. Pat. No. 4,151,776, Stich, 1979. Like U.S. Pat. No. 4,545,278, Gagon, et al., 1985, and U.S. Pat. No. 5,780,760, Riboloff, 1998, it has 3 single-coil pickups connected together at a common point, but it is not always grounded. It has a number of errors and Stich did not fully recognize or utilize the potentialities of that arrangement. The common point is grounded only when switch 52 is in the 1-position, and then only to obtain the single output of the bridge pickup (24); in that condition, none of the positions of the 3P4T switch 50 have any effect on the output.

When switch 52 is in the 2-position, the common point is ungrounded and switch 50 has 4 humbucking outputs, but Stich does not recognize them all as humbucking. For N being the neck pickup, M being the middle pickup and B being the bridge pickup, for positions 1 to 4 switch 50 produces, respectively, N+M, M+B, (N+B)/2+M and N-B. One has to suppose that these are the outputs, because Stich does not specifically identity this circuit set as humbucking, only stating that humbucking occurs. In Col. 1, lines 20-25, he states that two coils are "wound in opposite directions" to achieve humbucking, and then in Col. 5, lines 43-46, wrongly states that the humbucking out-of-phase combination, N-M, cannot be humbucking because the coils are wound in the same direction.

Throughout the patent specification, Stich attributes humbucking not to circuit connections but to pickups wound in opposite directions, apparently not recognizing that the same effect can be realized merely by reversing the connections of one of two coils wound in the same direction. Over the years, a great many guitar patents have made this conceptual mistake, apparently derived from the very first pickup humbucking patents, showing coils with different poles wound in different direction, i.e., U.S. Pat. No. 2,026,841, Lesti, 1936.

When switches 50, 52 and 54 are in positions 3, 2 and 1, Stich's circuit does achieve a humbucking triple. But this is hindsight; Stich does not claim or recognize it as such. In Claim 1, Stich refers not to any humbucking triple, but to separate signals from neck and middle and from the middle and bridge directed to output channels 1 and 2. Claim 3 incorrectly ascribes the $4^{th}$ position of switch 50 to connecting all three pickups together.

These facts clearly demonstrate that despite any similarities in circuit construction, Stich's patent cannot anticipate what Stich, or anyone else, neither saw nor taught nor claimed. Instead, Stich produced a circuit with 4*2*2=16 different combinations of switch positions with only 5 tonally distinct outputs. This inventor developed this invention independently of Stich, and found the Stich's patent to have similarities after the fact.

In another patent application U.S. Ser. No. 15/917,389, 2018-07-14, Baker disclosed that merely reversing the magnet in a humbucking circuit changes only the phase relation between pickups in the circuit, without affecting the humbucking nature of the circuit. For J number of matched single-coil pickups in a humbucking circuit, there are then $2^{J-1}$ number of different combinations of phase tonality, each sharing some tones with each other. In more recent calculations for a textbook, for common-point connection circuits of 2, 3, 4, 5 and 6 matched coils, there are 2, 18, 92, 540 and 1640 different tone circuits with reversible magnets. This patent application will reinvestigate if the number is correct for 3 matched coils, since math errors are always possible. Note however, that tones tend to bunch at the warm end, and there will be fewer tones that can actually be distinguished from one another.

It is not possible in most cases to achieve a full set of possibilities with mechanical switches, but in patent applications previous to this, Baker underestimated what could be done. This patent application offers more embodiments to the common-point connection switching system of U.S. Pat. No. 10,380,986, which takes advantage of improved switching design, based on FIGS. 1 & 2.

SUMMARY OF INVENTION

This invention derives directly from U.S. Pat. No. 10,380,986 (Baker, 2019). Primarily, it makes better use of the mode switches, SWa and SWb in FIG. 17 of U.S. Pat. No. 10,380,986, and similar functions in SW1 to SWj+k in the same Figure to provide a better-organized and expanded set of outputs for sets of either 3 single-coil pickups or 3 dual-coil humbucker pickups, in such a way that all of the electro-mechanical controls will fit on a standard-sized electric guitar. In addition, the expanded use of mode switches allows 3 dual-coil humbuckers to partially simulate 3 single-coil pickups with reversible magnets to see what kind of tonal options might result, and justify the inventions in NPPAs Ser. No. 15/917,389 (Baker, 2018), Ser. No. 16/752,670 (Baker, 2020) and Ser. No. 16/812,970 (Baker, 2020). While the invention can be extended to more than 3 pickups with the switch concatenation disclosed in FIG. 19 of U.S. Pat. No. 10,217,450 (Baker, 2019), the digital-analog switching in U.S. Pat. Nos. 10,217,450 or 10,380,986 would be more practical.

Technical Problems Found and Resolved

Baker underestimated the number of possible switching configurations that could be achieved with the common-point connection system using mechanical switches. Then realized (from a test configuration for U.S. Pat. No. 10,380,986) that violating the rules, and connecting the common point to either terminal of the output would allow a 3-coil circuit (with 6 humbucking choices) to present the musician with the non-humbucking outputs 1-pickup and 2-pickup combinations as well. Then realized that in doing this with 3 humbucking pickups, it could simulate tonal circuits for matched single-coil circuits with reversible magnets, and with a simple switch, could provide 9 different single, pair and triple combinations of 3 humbuckers as well. This allows investigation of the concepts of U.S. NPPA Ser. No. 15/917,389 before committing to any manufacture of pickups with reversible magnets.

DESCRIPTION OF THE INVENTION

Figure 1:
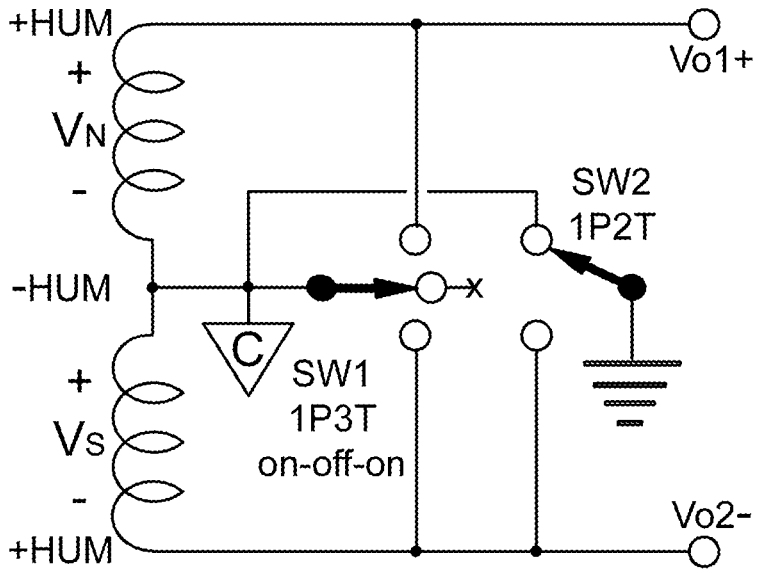
FIG. 1 shows the basic common-point connection system for two matched pickups, or a dual-coil humbucking, with opposite magnetic poles towards the strings.
Figure 2:
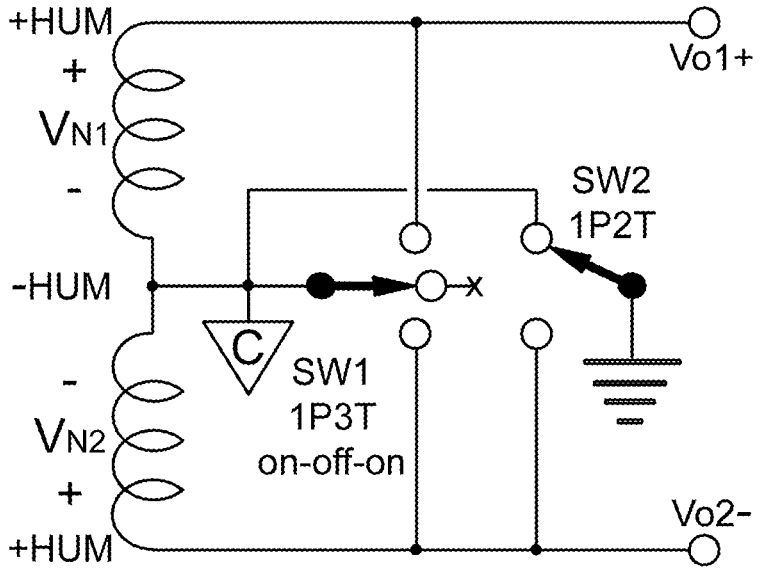
FIG. 2 shows the basic common-point connection system for two matched pickups with the same pole towards the strings.

These embodiments derive directly from U.S. Pat. No. 10,380,986 (Baker, 2019). Primarily, they make better use of the mode switches, SWa and SWb in FIG. 17, and similar functions in SW1 to SWj+k in the same Figure to provide a better-organized and expanded set of outputs for sets of either 3 single-coil pickups or 3 dual-coil humbucker pickups. In addition, the expanded use of mode switches allow 3 dual-coil humbuckers to partially simulate 3 single-coil pickups with reversible magnets to see what kind of tonal options might result, and justify the inventions in NPPAs Ser. No. 15/917,389 (Baker, 2018), Ser. No. 16/752,670 (Baker, 2020) and Ser. No. 16/812,970 (Baker, 2020). Most of the embodiments use a 3P6T switch to make pickup circuit connections, to simplify the circuit. They are actually based on a common, inexpensive 4P6T rotary switch. The uses of the $4^{th}$ pole were covered in FIG. 17 in U.S. Pat. No. 10,217,450 (Baker, 2019) and in FIGS. 7, 8, 10 & 11 in U.S. Pat. No. 10,380,986, and are discussed again in Embodiment 5 below. The more common 5-way switch used in electric guitars has an inexpensive 4P5T cousin, which can also be used, if one related set of humbucking/non-humbucking choices is eliminated.

In addition to the circuit connection switch, all of the embodiments use a main mode switch, of at least 1 pole and 2 throws. This switch chooses between 2 sets of 6 distinct circuits each, humbucking and non-humbucking for single-coil pickups, by either shorting or not shoring the common-point connection to ground. For circuits of matched, single-coil pickups, the non-shorting, or humbucking, position lets the connection switch choose between 3 humbucking pairs and 3 humbucking triples, in which all the pickups connected between the common point and ground are single pickups, and all those connected between the common point and the output high terminal are either single pickups or two pickups in parallel. The shorting or non-humbucking position shorts out all the single-pickup choices to ground, limiting the chosen circuit to distinct single-pickup circuits or two pickups in parallel.

This is modified in Embodiment 2, in which added poles on the mode switch change two of the pairs from non-humbucking to humbucking, at the expense of duplicating two tones in the non-shorting mode. In Embodiment 3, 3 dual-coil humbucking pickups are used, providing 12 all-humbucking choices for both positions of the mode switch. In Embodiment 4, additional mode switches allow the dual-coil humbuckers to act like single-coil pickups with either magnetic pole up.

Figure 3:
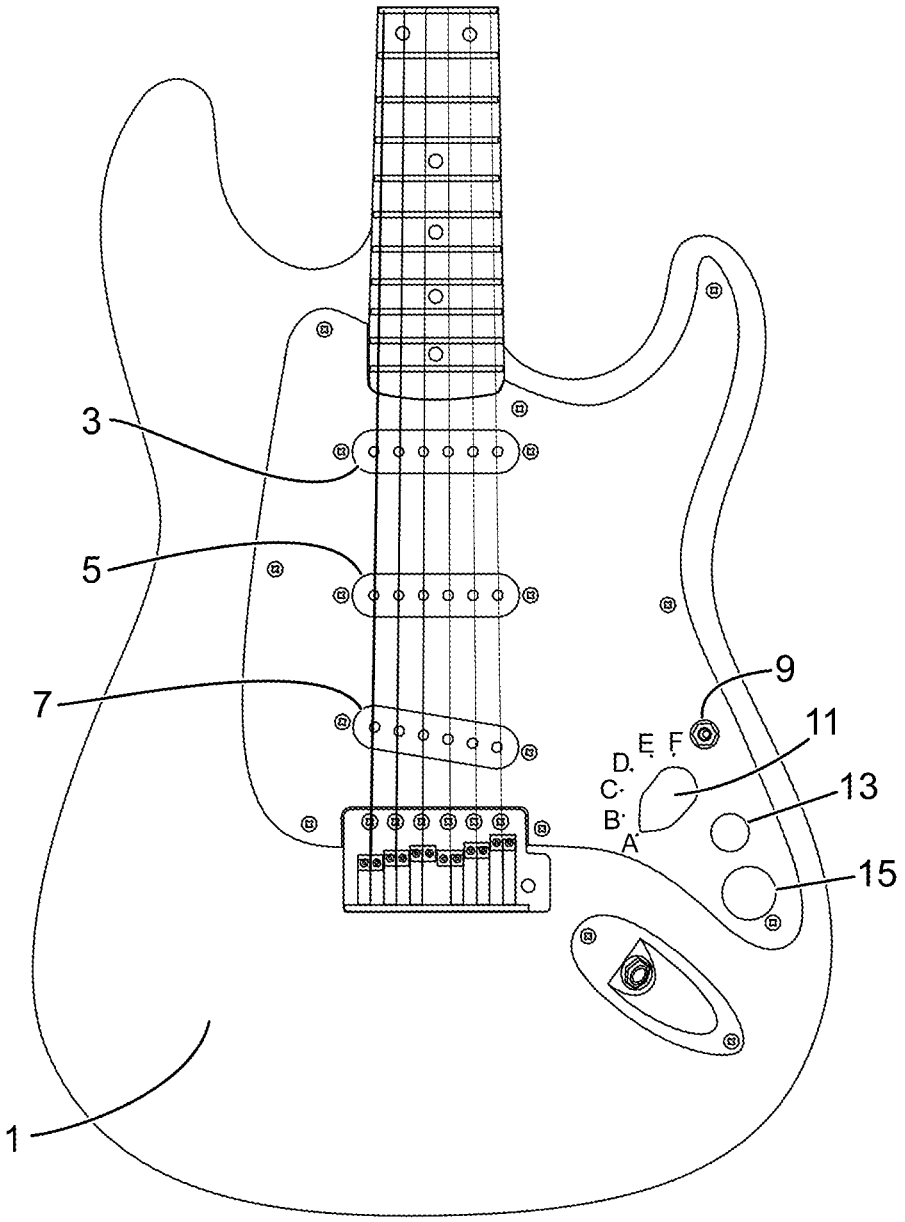
FIG. 3 shows a standard 3-coil electric guitar with a pickguard and controls modified to accommodate a common-point switch system with a HB/non-HB mode switch (9) and a 6-way circuit selector switch (11).

Embodiment 1: 3-Coil Electric Guitar with Both Humbucking and Non-Humbucking Outputs, Ordered for Humbucking Outputs FIG. 3 shows a common 3-coil Fender Stratocaster (1), with nominally matched pickups at the neck (3), middle (5) and bridge (7) positions. The pickguard has modified to accommodate a common-point connection pickup switching circuit, with a humbucking/non-humbucking mode switch (9), a 6-way circuit selection switch (11), a tone control (13) and a volume control (15).

Figure 4:
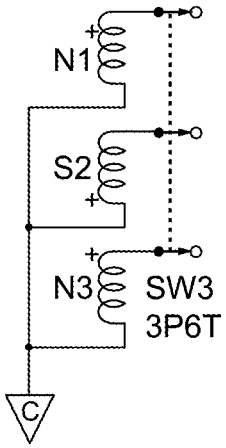
FIG. 4 shows the pickup coils in FIG. 3, designated N1 (neck (3), North-up pole), S2 (middle (5), South-up pole) and N3 (bridge (7), North-up pole) connected to the switch poles of a 3P6T switch, SW3, with the throw connections undefined.

Now consider the three pickups represented by coils N1 (neck), S2 (middle) & N3 (bridge) in FIG. 4 (pickups 1, 3 & 5 in FIG. 3), with a common-point hum connection (C-triangle), connected to the 3P6T SW3, with connections yet to be determined. The string signals from N1 and N3 are considered positive in phase, while the string signal from S2 is considered negative in phase. If one of the pickups is connected to the high output terminal, and one or two of the remaining pickups is connected to the low output terminal, and the common point is not, then there are 6 possible humbucking output signals, with (N1+S2), (S2+N3) and (N1−N3) as humbucking doubles and (N1+(S2−N3)/2), −(S2+(N1+N2)/2) and (N3+(S2−N1)/2) as humbucking triples. In this case the minus sign on −(S2+(N1+N2)/2) has no practical use, so it can be written as (S2+(N1+N2)/2). If the common point is connected to either the high or low output terminal, then we also have the non-humbucking signals N1, S2, N3, (S2−N1), (S2−N3) and (N1+N3).

Figure 5:
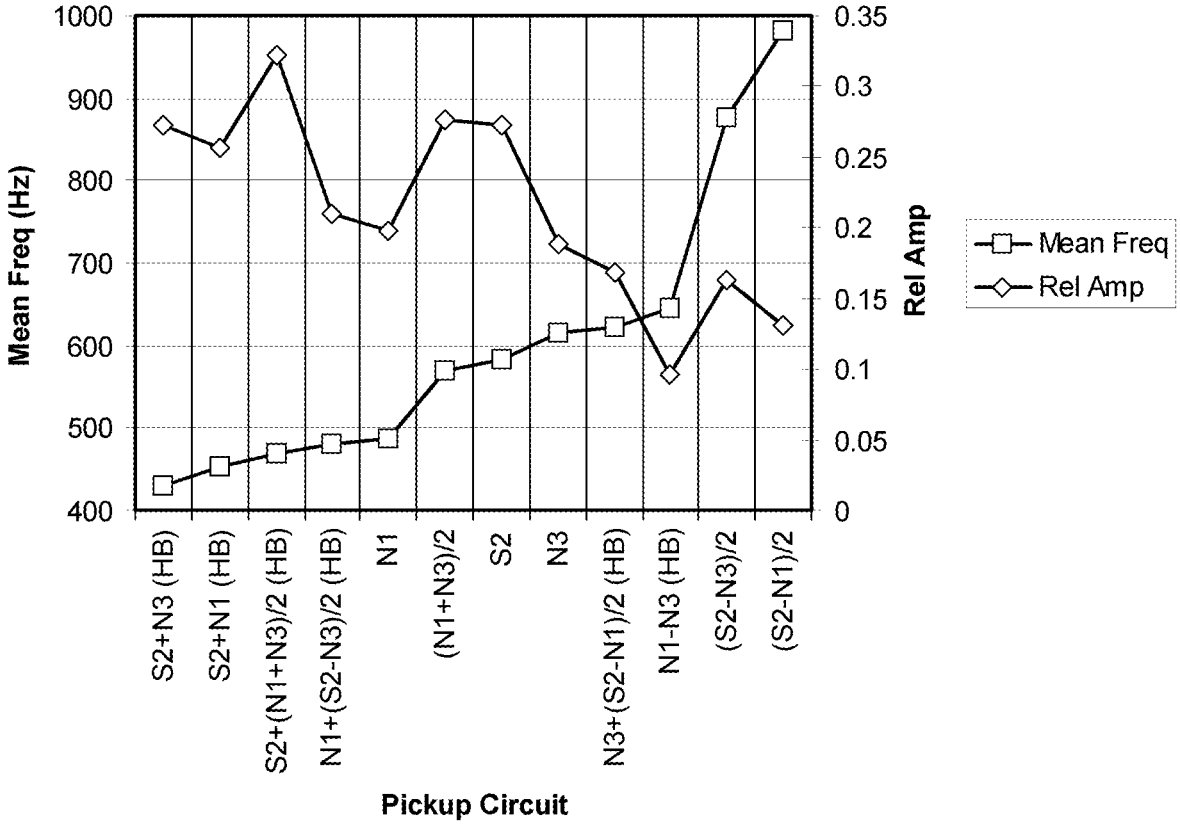
FIG. 5 shows those results for FIG. 4, with Mean Frequency (Hz) on the left vertical axis with points shown as squares, and Relative Signal Amplitude shown on the right vertical axis with points shown as diamonds, where the possible humbucking circuits have outputs of: (N1+S2), (S2+N3), (N1−N3), (N1+(S2−N3)/2), −(S2+(N1+N2)/2) and (N3+(S2−N1)/2); and the possible non-humbucking outputs, with the common point connected to one of the output terminals, are: N1, S2, N3, (S2−N1), (S2−N3) and (N1+N3).

A Windows program, SpecAn_3v97c.exe (Speer, 2001-2016), produces FFT spectra from an audio signal to the sound board mic input. These outputs were analyzed with this program with the following settings: 135 dB log audio scale; zero weighting; log frequency scale; display set to spectrograph w/ averaging; 8 kHz sample rate; 4096 FFT size (~2 Hz wide bins); and the Hanning window. The program produces an output amplitude spectrum with 2048 values about 1.95 Hz apart, rounded to from 0 to 3998 Hz. The outputs were generated by strumming all six strings over the middle pickup five times at about once per second, with no fretting. When the signal had significantly decayed, the sampling process was stopped, and the data saved. It produced on the order of 50 FFT windows, all averaged together, lasting 12 to 15 seconds. Imported into a spreadsheet, the data was processed according to Math 8 in U.S. Pat. No. 10,380,986 (col. 20), reproduced here as Math 1, to give the relative signal amplitude and the mean frequency in Hertz. FIG. 5 shows those results for FIG. 4, with Mean Frequency (Hz) on the left vertical axis with points shown as squares, and Relative Signal Amplitude shown on the right vertical axis with points shown as diamonds.

Math 1

$$linV_n(f_n) = 10^{dBFS_n/20},\ 1 \le n \le 2048$$

$$\text{Relative signal amplitude} = \sum_{n=1}^{2048} linV_n$$

$$P_V(f_n) = \frac{linV_n}{\sum_{n=1}^{2048} linV_n}$$

$$\text{mean.}f = \sum_{n=1}^{2048} f_n * P_V(f_n)$$

$$\text{2nd.moment.}f = \sum_{n=1}^{2048} (f_n - \text{mean.}f)^2 * P_V(f_n)$$

$$\text{3rd.moment.}f = \sum_{n=1}^{2048} (f_n - \text{mean.}f)^3 * P_V(f_n).$$

Now suppose that we wire the throw connections of the unfinished switch, SW3, in FIG. 4, so that the humbucking connections ascend in mean frequency of output. Mean frequency may be a poor representation of perceived audio tone, but it can be used to develop the approach until something better comes along. Table 1 shows how shorting the common-point connection to the upper or lower voltage output for humbucking connections of the pickups in FIG. 4 produces non-humbucking outputs with duplicate outputs and mean frequencies. When the common point is shorted to the lower voltage output, N1 is repeated 3 times and N3 twice in the SW3 throws. When the common point is shorted to the upper voltage output, S2 is repeated three times.

TABLE 1

Measured mean frequencies (Hz), according to the method described above, where Upper designates the pickup or pickups connected from the common-point connection to the upper voltage output for different SW3 throws; Lower designates the pickups connected from the common point to the lower voltage output; $MF_{HB}$ is the mean frequency (Hz) for the humbucking outputs, where the common point is unconnected to either output; $MF_{UPPER}$ designates the non-humbucking mean frequency for the common point connected to the lower output, shorting out the lower pickups; and $MF_{LOWER}$ is the non-humbucking mean frequency for the common point connected to the upper voltage output, shorting out the upper pickups. Some total signs have been reversed to keep the first sign positive.

| SW3 Throw | A | B | C | D | E | F |
|---|---|---|---|---|---|---|
| $MF_{HB}$ | 430 | 453 | 469 | 479 | 622 | 646 |
| $MF_{UPPER}$ | 615 | 486 | 569 | 486 | 615 | 486 |
| Upper | N3 | N1 | (N1 + N3)/2 | N1 | N3 | N1 |
| Lower | S2 | S2 | S2 | (S2 − N3)/2 | (S2 − N1)/2 | N3 |
| $MF_{LOWER}$ | 584 | 584 | 584 | 876 | 981 | 615 |

TABLE 2

Measured mean frequencies (Hz), according to the method described above, for a different set of connections, where Upper designates the pickup or pickups connected from the common-point connection to the upper voltage output for different SW3 throws; Lower designates the pickups connected from the common point to the lower voltage output; $MF_{HB}$ is the mean frequency (Hz) for the humbucking outputs, where the common point is unconnected to either output; and $MF_{UPPER}$ designates the non-humbucking mean frequency for the common point connected to the lower output, shorting out the lower pickups. Some total signs have been reversed to keep the first sign positive.

| SW3 Throw | A | B | C | D | E | F |
|---|---|---|---|---|---|---|
| $MF_{HB}$ | 430 | 453 | 469 | 479 | 622 | 645 |
| $MF_{UPPER}$ | 584 | 486 | 569 | 876 | 981 | 615 |
| Upper | S2 | N1 | (N1 + N3)/2 | (S2 − N3)/2 | (S2 − N1)/2 | N3 |
| Lower | N3 | S2 | S2 | N1 | N3 | N1 |

Table 2 shows a better result with 6 fewer outputs. It shows the same sequence of humbucking mean frequencies for SW3 Throws A-F, but with the circuit inverted at throws A, D, E & F, so that when the common point is connected to the lower voltage output, the non-humbucking combinations in the Upper set do not repeat. Note that a number of minus signs have been removed. For example, Throw A should show −S2 and −N3, but the inverse signal (S2+N3) is used, because no one has shown that human ears can tell the difference. But while the lower non-humbucking mean frequencies are generally to the left, with higher to the right, they are not in order. It is generally not possible to order both sets of frequencies with this kind of mechanical switching. You can order one or the other, but not both.

Figure 6:
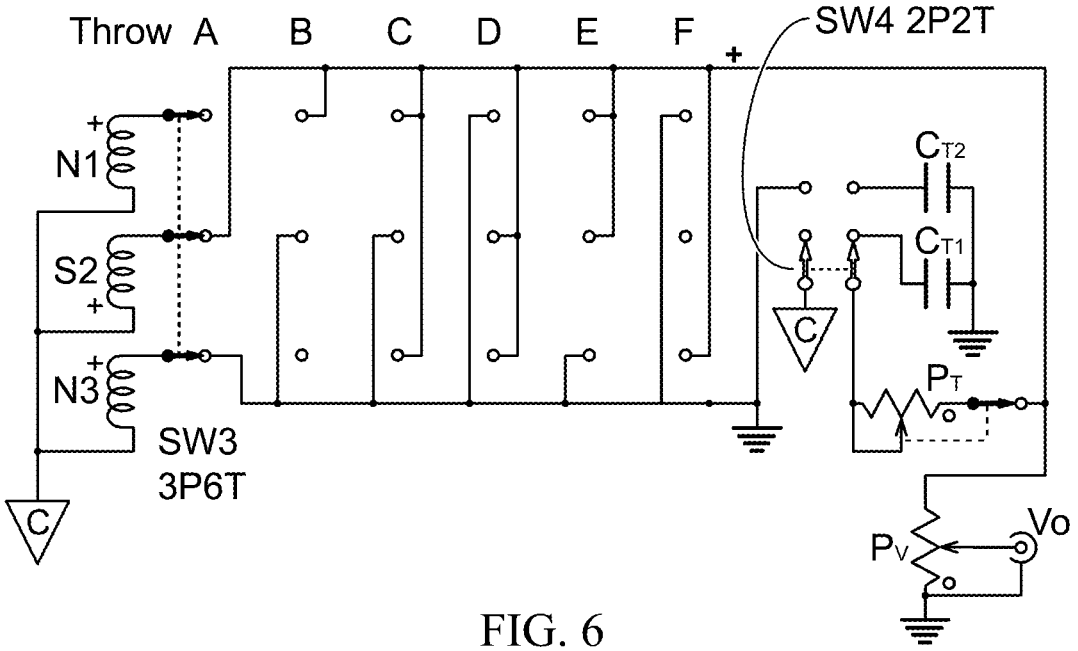
FIG. 6 shows the circuit for the first embodiment, a common-point switching circuit for 3 matched single-coil pickups, N1 (neck, North-up), S2 (middle, South-up) & N3 (bridge, North-up), with a 3P6T switch, SW3, ordering the humbucking pairs and triples by increasing mean frequency from Throws A to F. The mode switch, SW4, allows all humbucking signals, with a tone capacitor, $C_{T1}$, in the lower position, and all non-humbucking signals, with another tone capacitor, $C_{T2}$, in the upper position. The tone pot, $P_T$, has an integral unloading switch at the high frequency end. The volume pot, $P_V$, and output, Vo, are as shown.

FIG. 6 shows how Table 2 expands the circuit in FIG. 4, filling in Throws A-F in the 3P6T switch, SW3. In the lower position, the 2P2T mode switch, SW4, does not short any pickups to ground, assuring that the output, Vo, gets the humbucking pair and triple signals. The other pole of SW4 uses $C_{T1}$ as the tone capacitor with tone pot, $P_T$, which has an integral unloading switch at the high frequency end. In the upper position, SW4 shorts the common-point connection and Lower pickups to ground, assuring that the outputs at Vo are all non-humbucking. It also sets $C_{T2}$ as the tone capacitor. When the outputs are all humbucking, the matched inductance, L, of the pickups produces a lumped inductance of 2L for humbucking pairs, and a lumped inductance of 3L/2 for humbucking triples, for an average lumped inductance of $L_H$=1.75*L. For non-humbucking outputs, the average lumped inductance is the average lumped inductance of the switched pickups is $L_N$=0.75*L. The high-frequency peak or roll-off point with a tone capacitor, $C_T$, connected in parallel with an inductance, L, is proportional to $(L*C)^{-1/2}$, then to keep the peak or roll-off roughly the same for both humbucking and non-humbucking signals, then $L_H*C_{T1}=L_N*C_{T2}$, or $C_{T2}=1.75*C_{T1}/0.75=2.333*C_{T1}$. Other strategies and values may be equally valid, depending on the intended application.

As noted already, this use of mean frequency of the amplitude spectrum may not be the best measure of perceived tone. Human perception of tone is complex, being dependent upon both the frequency and amplitude of adjacent signals, as well as the harmonics present. But when a better measure becomes available, the ordering of tones can be easily redesigned or rewired on the switch.

Embodiment 2: 3-Coil Electric Guitar with Both Humbucking and Non-Humbucking Outputs, Ordered to Match a Standard 5-Way Switch Note that in Table 2 and FIG. 6 the non-humbucking combination of the middle and bridge pickups in parallel and the middle and neck pickups in parallel form an out-of-phase non-humbucking circuit, while the standard 5-way switch forms nominally humbucking in-phase circuit with the same two pairs. So the 5 signals of the standard 5-way switch can be duplicated in the 6-way switch, by simply adding two more poles to the mode switch to reverse the connections of the middle pickup for non-humbucking signals.

Figure 7A:
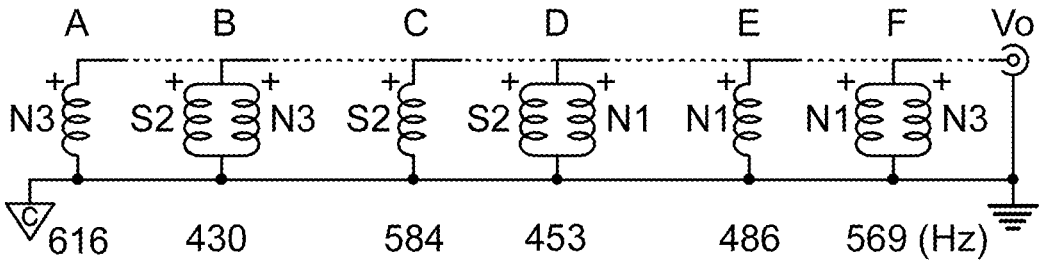
FIG. 7A shows the desired circuits for the 6 switch throws A-F, with the common point grounded, duplicating the switching order of a standard 3-coil guitar 5-way switch, plus one, the neck pickup in parallel with the bridge. The output signals are: N3, (S2+N3), S2, (S2+N1), N1 and (N1+N3). The measured mean frequencies are listed below their pickup combinations. Note that the pickup pair combinations are humbucking, but the single-pickup choices are not.
Figure 7B:
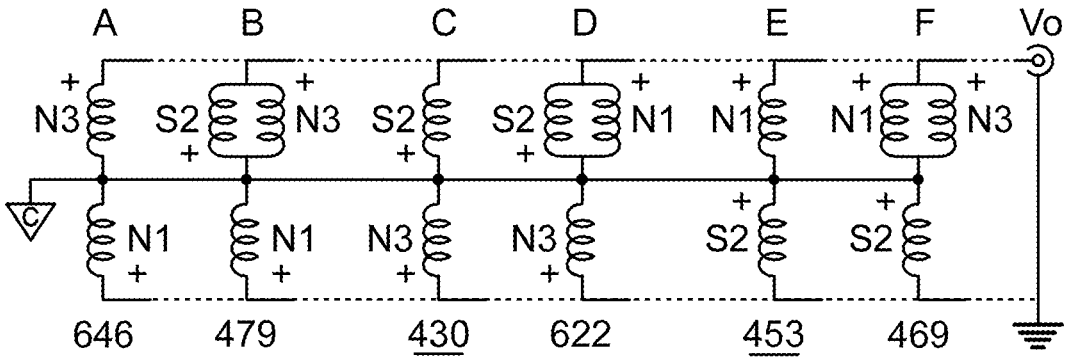
FIG. 7B shows the humbucking pair and triple circuits for switch throws A-F that result from the choices in FIG. 7A, with the common point not grounded. The measured mean frequencies (Hz) listed below their circuits. Measured mean frequencies for circuits that have the same unloaded mean frequencies as those in FIG. 7A are underlined. The output signals are (N3−N1), (N3−S2)/2−N1, −(S2+N3), (N1−S2)/2−N3, (N1+S2), (N1+N3)/2+S2. Note that all the S2 (middle) pickups have a signal phase with respect to the common point which is opposite that in FIG. 7A.

FIG. 7A shows the desired circuits for the 6 switch throws A-F, with the common point grounded, duplicating the switching order of a standard 3-coil guitar 5-way switch, plus one, the neck pickup in parallel with the bridge. The output signals are: N3, (S2+N3)/2, S2, (S2+N1)/2, N1 and (N1+N3)/2. The measured mean frequencies are listed below their pickup combinations. Note that the pickup pair combinations are humbucking, but the single-pickup choices are not. FIG. 7B shows the humbucking pair and triple circuits for switch throws A-F that result from the choices in FIG. 7A, with the common point not grounded. The measured mean frequencies (Hz) listed below their circuits. Measured mean frequencies (Hz) for circuits that have the same unloaded mean frequencies as those in FIG. 7A are underlined. The output signals are (N3-N1), (N3−S2)/2−N1, −(S2+N3), (N1−S2)/2−N3, (N1+S2), and (N1+N3)/2+S2. Note that all the S2 (middle) pickups have a signal phase with respect to the common point which is opposite that in FIG. 7A.

Figure 8:
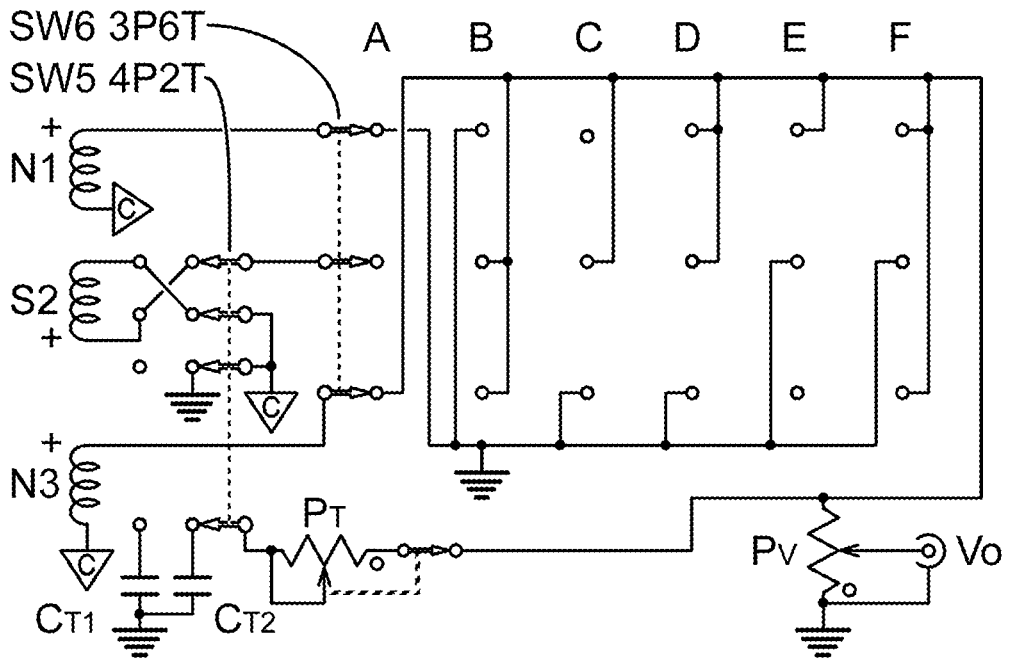
FIG. 8 shows the embodiment of the common-point switching system for the choices in FIGS. 7A & 7B, with matched single-coil pickups N1 (neck), S2 (middle) and N3 (bridge), where N1 & N3 have North-up poles and S2 has a South-up pole. The 4P2T mode switch, SW5, sets the non-humbucking single and humbucking pair circuits in FIG. 7A at the right throw, grounding the common point (C-triangle), grounding the +HUM side of S2, and setting the tone capacitor to $C_{T2}$. The left throw of SW5 sets the tone capacitor to CT1, ungrounds the common point, and sets the −HUM side of S2 to the common point and enables the circuits in FIG. 7B. Thus the pair combinations of S2 with N1 and N3 are humbucking for both settings of SW5. The A-F throws of the 3P6T switch, SW6, set the choices shown in FIGS. 7A & 7B, depending on the throw of SW5.

FIG. 8 shows the embodiment of the common-point switching system for the choices in FIGS. 7A & 7B, with matched single-coil pickups N1 (neck), S2 (middle) and N3 (bridge), where N1 & N3 have North-up poles and S2 has a South-up pole. The 4P2T mode switch, SW5, sets the non-humbucking single and humbucking pair circuits in FIG. 7A at the right throw, grounding the common point (C-triangle), grounding the +HUM side of S2, and setting the tone capacitor to $C_{T2}$. The left throw of SW5 sets the tone capacitor to CT1, ungrounds the common point, and sets the −HUM side of S2 to the common point and enables the circuits in FIG. 7B. Thus the pair combinations of S2 with N1 and N3 are humbucking for both settings of SW5. The A-F throws of the 3P6T switch, SW6, set the choices shown in FIGS. 7A & 7B, depending on the throw of SW5.

Figure 9A:
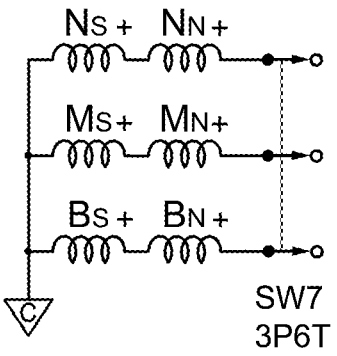
FIG. 9A shows each the three single-coil pickups in FIGS. 4 & 6 replaced by dual-coil humbucking pickups, N (neck), M (middle) and B (bridge), with the N-up and S-up coils connected in series in FIG. 9A, and symbolized by a letter in a square in FIG. 9B, with the string signal positive phases shown by "+" signs.
Figure 9B:
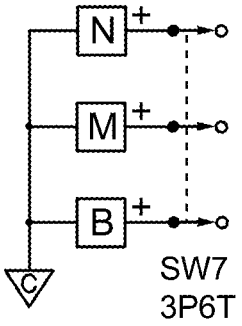
Figure 10:
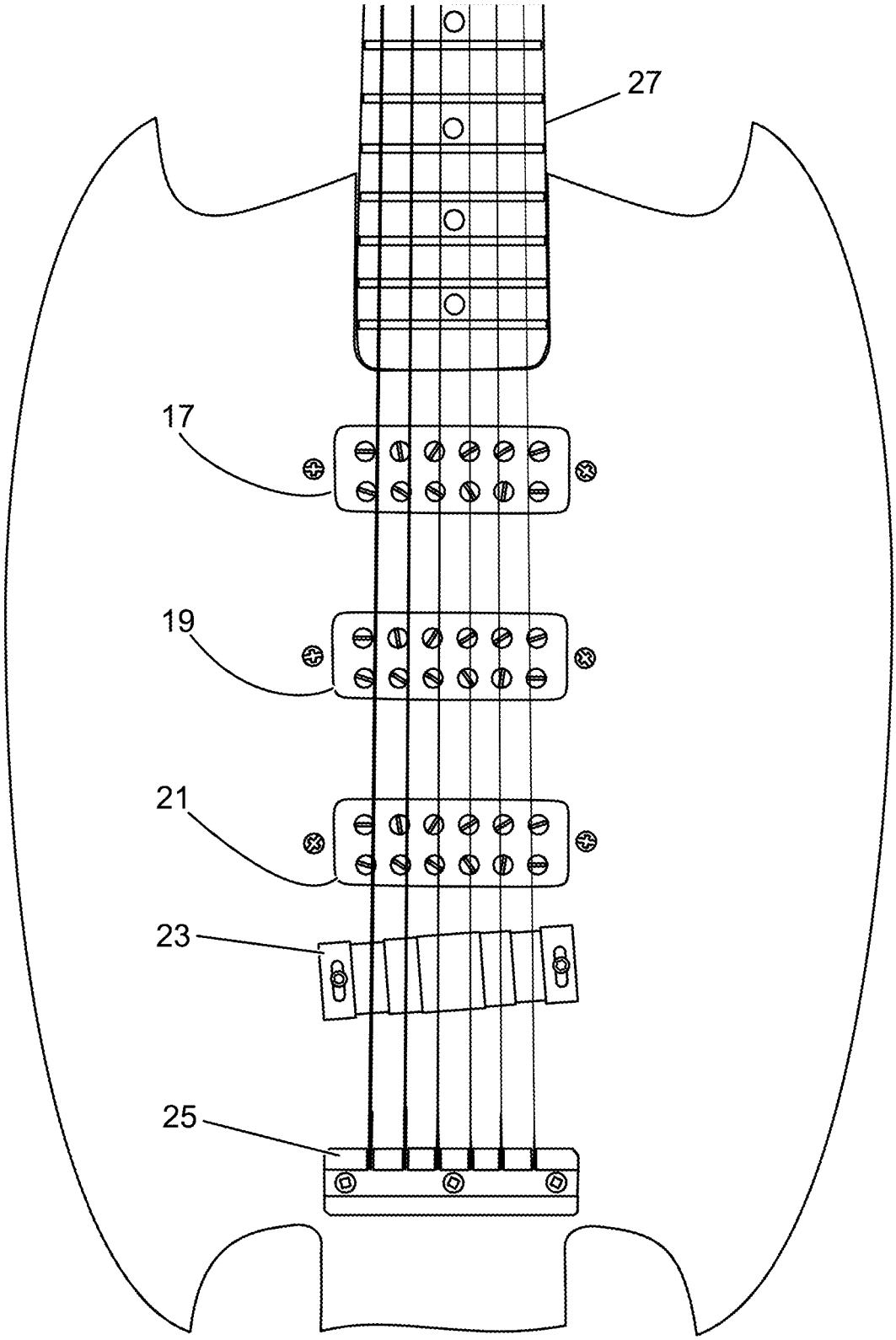
FIG. 10 shows the instrument used in the humbucking pickup measurements, with vintage-style dual-coil humbuckers at the neck (17), middle (19) and bridge (21) positions, on a prototype guitar with a 21-fret neck (27), having a standard 25.5" scale, and a non-conventional bridge (23) and tailpiece (25).

Embodiment 3: 3-Humbucker Electric Guitar with a Common-Point Connection Switching System Suppose now that instead of 3 matched single-coil pickups, FIG. 6 uses 3 dual-coil humbucking pickups, with the coils connected in series internally in each humbucker. FIG. 9A shows each the three single-coil pickups in FIGS. 4 & 6 replaced by dual-coil humbucking pickups, N (neck), M (middle) and B (bridge), with the N-up and S-up coils connected in series in FIG. 9A, and symbolized by a letter in a square in FIG. 9B, with the string signal positive phases shown by "+" signs. FIG. 10 shows the instrument used in the humbucking pickup measurements, with vintage-style dual-coil humbuckers at the neck (17), middle (19) and bridge (21) positions, on a prototype guitar, called the White Axe, with a 21-fret neck (27), having a standard 25.5" scale, and a non-conventional bridge (23) and tailpiece (25). The North poles of the pickups are towards the neck, and the pole screws were left flat in the top of the pickup body.

TABLE 3

The 12 possible common-point switched configurations of 3 humbuckers, with the relative amplitude (Rel Amp) and mean frequency (Mean Freq, Hz) calculated by an adjusted Math 1 from the sum of the linear sound board signal amplitudes of the spectra in the range of 70 ≤ fn ≤ 3998 Hz, from 6 strings picked five times.

| Single | Rel Amp | Avg Freq | Sum Pair | Rel Amp | Avg Freq | Diff Pair | Rel Amp | Avg Freq | Triple | Rel Amp | Avg Freq |
|---|---|---|---|---|---|---|---|---|---|---|---|
| N | 0.65 | 506 | (N + M)/2 | 0.95 | 526 | N − B | 0.18 | 740 | −B + (N + M)/2 | 0.33 | 553 |
| M | 0.69 | 627 | (M + B)/2 | 0.63 | 617 | M − B | 0.15 | 954 | −N + (M + B)/2 | 0.23 | 954 |
| B | 0.43 | 809 | (N + B)/2 | 0.75 | 620 | N − M | 0.14 | 999 | −M + (N + B)/2 | 0.21 | 1009 |

Table 3 shows the possible connections of three humbuckers in a common-point switching system with a mode switch to short the common point to one of the outputs, along with the relative amplitude and mean frequency (Hz). The signal spectra were generated and calculated by the same methods as before, except that in this case, spectral outputs of less than 70 Hz were discarded by calculating Math 1 for 37≤n≤2048.

Figure 11:
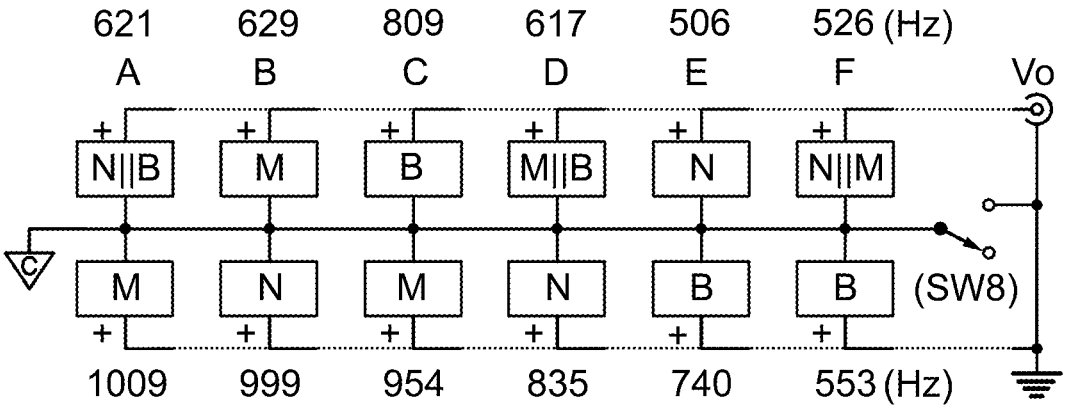
FIG. 11 shows an ordering of connections on throws A-F of SW7 for the humbuckers in FIG. 9, with one pole of the mode switch, SW8, shown in a non-shorting position (down). The measured mean frequencies from Table 3 on the bottom line show the ordering from bright to warm for the pole of SW8 down. The mean frequencies on the top line show the ordering for the pole of SW8 up.

FIG. 11 shows an ordering of connections on throws A-F of SW7 for the humbuckers in FIG. 9, with one pole of the mode switch, SW8, shown in a non-shorting position (down). N||B indicates that the neck humbucker is connected in parallel with the bridge humbucker, in-phase. The measured mean frequencies from Table 3 on the bottom line show the ordering from bright to warm for the pole of SW8 down. The mean frequencies on the top line show the ordering for the pole of SW8 up. As before, only one of those mode switch positions can be ordering monotonically.

Figure 12:
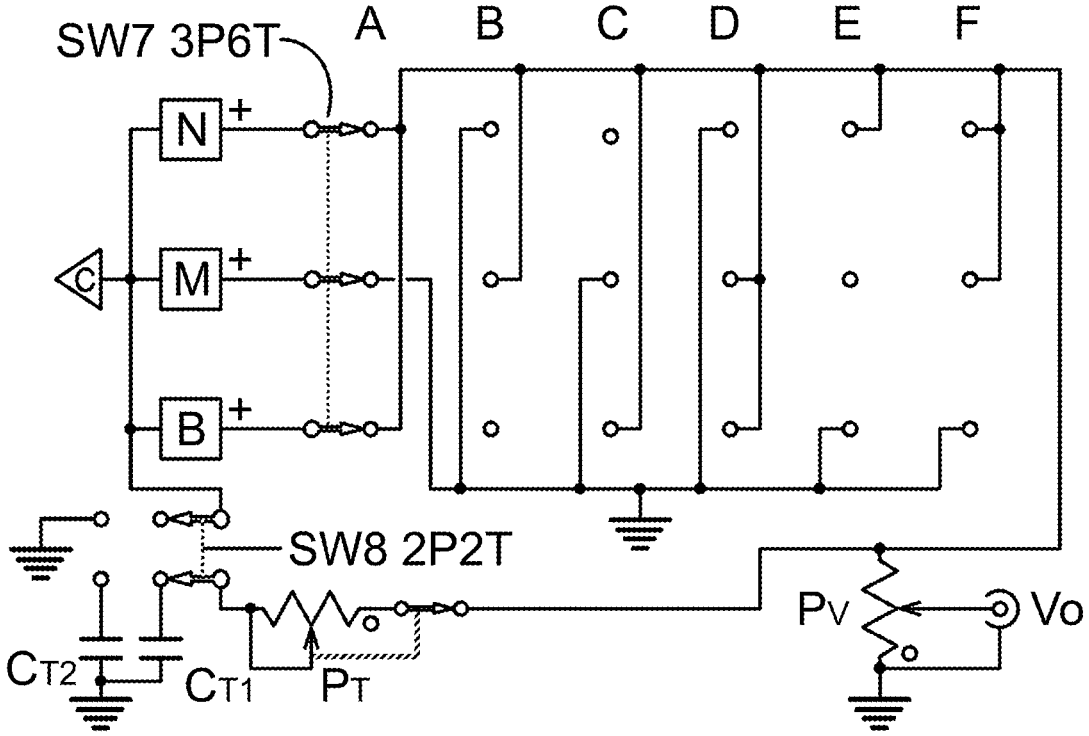
FIG. 12 show the implementation of the order of switching 3 humbucking pickups, N, M & B, in FIG. 11, using the 3P6T pickup switch, SW7, and the 2P2T mode switch, SW8, with all the other features of FIG. 8.

FIG. 12 show the implementation of the order of switching 3 humbucking pickups, N, M & B, in FIG. 11, using the 3P6T pickup switch, SW7, and the 2P2T mode switch, SW8, with all the tone and volume features of FIG. 8. In this case, if the lumped inductance of a series connected humbucking is L, then the average lumped inductance of a switched pickup circuit is again 0.75L when the mode switch shorts the common point to ground, and the average lumped inductance of a switched pickup circuit when the non-shorted common point is again 1.75L. So the ratio of $C_{T2}$ to $C_{T1}$ still holds at 2.333.

Note that three of the mean frequencies, 617, 621 and 629 Hz, are very close together. When the prototype guitar switching circuit disclosed in Embodiment 2 was played, Not only were two nominally humbucking signals in the equivalent 5-way switch set, (S2+N3)/2 and (S2+N1)/2, duplicated in the humbucking set by (S2+N3) and (S2+N1), but two of the humbucking signals sounded a lot alike. This meant that there were only 9 or 10 distinct tones out of the 12 for Embodiment 2. Without further study, this could mean that those three tones for this embodiment are also very similar, dropping the number of distinct tones from 12 to 10. Note that the 1 to 1.99 spread of all-humbucking mean frequencies from 506 Hz to 1009 Hz in embodiment 3 compares roughly to the 1 to 2.28 spread of mean frequencies from 430 Hz to 981 Hz in embodiment 2, where three of the output signals are non-humbucking.

Embodiment 4: 3-Humbucker Common-Point Switching with Mode Switches Simulating Single-Coil Pickups with Reversible Magnets The circuit in FIG. 12 can be modified with additional mode switches to use the dual-coil humbuckers either as in FIG. 12, or as three single-coil pickups, one from each humbucker, either the N-up coil (Nn, Mn & Bn) or the S-up coil (Ns, Ms & Bs). Consider FIG. 1 again, where the upper coil with signal $V_N$ is the N-up coil of the humbucker, and the lower coil with signal $V_S$ is the S-up coil. For a single-coil mode, the center of the humbucker is connected to the common point, and one or the other coil is chosen for input to the 3P6T pickup combination switch. This roughly simulates having 3 single-coil pickups with reversible magnets. But since the N-up coils are closer to the neck and the S-up coils are closer to the bridge, it's not quite the same thing.

Reconsidering FIG. 11 as single-coil pickups, there are 12 possible pickup configurations in FIG. 11, including both positions of one pole of the mode switch, (SW8). For single-coil modes, each instance of N, M and B can be Nn or Ns, Mn or Ms and Bn or Bs. But for example, Nn has to be Nn for all of the 12 pickup combinations, and Nn and Ns cannot for this embodiment be in the same circuit. So, ordering n and s like binary numbers, we can have 12 combinations of the 8 sets: (Nn,Mn,Bn), (Nn,Mn,Bs), (Nn, Ms,Bn), (Nn,Ms,Bs), . . . (Ns,Ms,Bs), for a total of 96 single-coil switch combinations using common-point switching with mode switches.

But 96 switch combinations are not 96 different coil combinations or tones. In the shorted mode of SW8 in FIG. 11, changing the magnetic polarity of N changes only half of the pickup coil combinations. In the non-shorted mode, changing N changes 5 of the 6 pickup coil combinations. Altogether, only 8 of the 12 switch combinations produce different pickup combinations by changing the magnetic polarity of just one coil. Because the reversing switch used in FIG. 8, 2 poles of SW5, is not available for any of the single-coils, none of the pickup combinations with SW8 shorting the common point to ground can be humbucking.

When (SW8) is in the up position, shorting the common point to ground, all the switch combinations can produce only 6 different single-pickup circuits: Ns, Nn, Ms, Mn, Bs and Bn. For the pickup pairs, N||B, M||N and B||M, there are the same six choices for the first pickup, and four choices for the second pickup, less duplicates, as shown in Table 4. Half the 24 second choices for duplicates, leaving only 12 distinct combinations. The other 12 combinations are merely inverted, which the human ear cannot generally detect.

TABLE 4

Combinations of 2 of 3 single-coil pickups with reversible magnets. There are 6 first choices, 12 distinct second choices, and 12 choices where the combination is merely inverted.

| $1^{st}$ choice | Nn | Ns | Mn | Ms | Bn | Bs |
|---|---|---|---|---|---|---|
| $2^{nd}$ choices | Mn | Mn | ~~Nn~~ | ~~Nn~~ | ~~Mn~~ | ~~Mn~~ |
| | Ms | Ms | ~~Ns~~ | ~~Ns~~ | ~~Ms~~ | ~~Ms~~ |
| | Bn | Bn | Bn | Bn | ~~Nn~~ | ~~Nn~~ |
| | Bs | Bs | Bs | Bs | ~~Ns~~ | ~~Ns~~ |

Now consider the humbucking doubles and triples in FIG. 12, where the common point is not grounded. The humbucking doubles are magnetic variations of M-N, B-M and N-B from FIG. 11. Again, there are 6 first choices of pickup, with 12 distinct second choices. For each humbucking triple, there are 6 distinct choices of the coil connected the common point to ground in FIG. 11. Take Ns, for example; there are four distinct choices of the other two coils connected to each other in parallel between the common point and the output: (Mn,Bn), (Mn,Bs), (Ms,Bn) and (Ms,Bs). That means 6*4=24 distinct choices of coil circuits for humbucking triples. So the distinct choices of non-humbucking singles and pairs add up to 18, and the distinct choices of humbucking pairs and triples add up to 36, for a total of 54. Add in the 3 choices of dual-coil humbuckers one at a time, 3 choices of dual coil humbuckers adding in parallel two at a time, 3 choices of dual coil humbuckers subtracting in series two at a time and 3 choices of dual-coil humbuckers in triples, such a switching system can produce 54+12=66 distinct choices out of 96+12=108 different switching combinations, for a switching efficiency of 61%.

Figure 13:
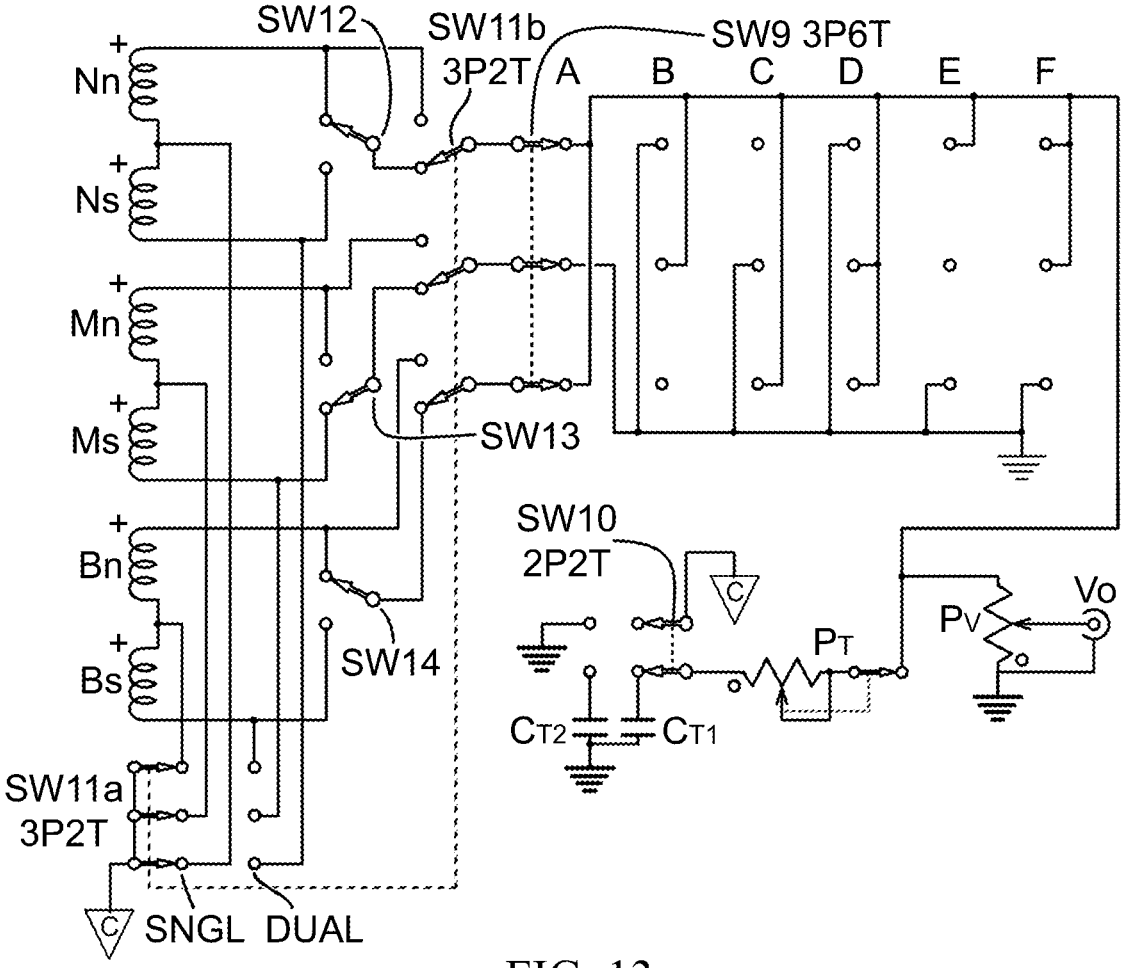
FIG. 13 shows an embodiment which adds mode switches to FIG. 12 to produce humbucking and non-humbucking circuits from individual humbucker coils, as if they were 3 single-coil pickups. SW9 is the same as SW7 in FIG. 12, and SW 10 is the same as SW8 in FIG. 12, with the same tone and volume controls. Mode switch, SW11*ab*, can be either a single 6P2T rotary switch, to two ganged 3P2T toggle switches. In the SNGL position, it connects the common point of the switching system to the internal center-tap of each humbucker, and allows modes switches, SW12, SW13 and SW14 to select either the N-up or the S-up single coil from each humbucker. In the DUAL position, it disables SW12-14, connects the S-up coils to the common point and the N-up coils to the poles of SW9, enabling the full-humbucker mode with all-humbucking circuits.

FIG. 13 shows how this embodiment adds mode switches to FIG. 12 to produce humbucking and non-humbucking circuits from individual humbucker coils, as if they were 3 single-coil pickups. SW9 is the same 3P6T circuit switch as SW7 in FIG. 12, and SW 10 is the same common-point mode switch as SW8 in FIG. 12, with the same tone and volume controls. Mode switch, SW11*ab*, can be either a single 6P2T rotary switch, to two ganged 3P2T toggle switches, or any other switch which performs the same function. In the SNGL position, SW11*ab* connects the common point of the switching system to the internal center-tap of each humbucker, and allows modes switches, SW12, SW13 and SW14 to select either the N-up or the S-up single coil from each humbucker. This produces 96 switching combinations with 54 distinct circuits. In the DUAL position, it disables SW12-14, connects the S-up coils to the common point and the N-up coils to the poles of SW9, enabling the full-humbucker mode with all 12 humbucking circuits. This produces 12 switching combinations with 12 distinct pickup circuits.

Figure 14:
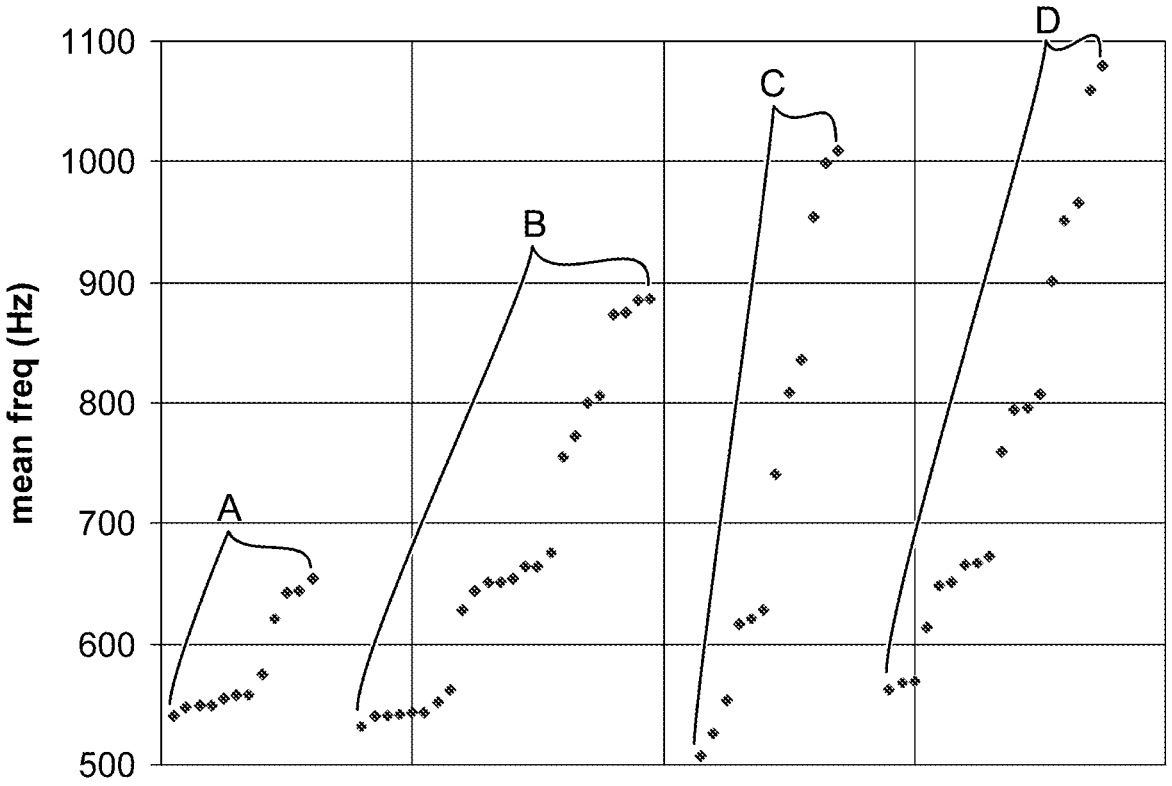
FIG. 14 shows four groups of mean frequencies in ascending order, measured from the distinct circuits that FIG. 13 can produce. Group A are the single-coil humbucking doubles, numbering 12, extending from 540 to 654 Hz. Group B are the single-coil humbucking triples, numbering 24, extending from 532 to 886 Hz. Group C are the dual-coil humbucking singles, doubles and triples, numbering 12, extending from 506 to 1009 Hz. Group D are the non-humbucking single-coil singles, pairs and triples, numbering 18, extending from 562 to 1080 Hz.

All of the possible common-point switching single-coil single, double and triple coil circuits from single coils of each humbucker were measured in the manner previously described, by strumming 6 strings above the middle pickup 5 times, while taking audio samples for an FFT program. Here again, Math 1 was modified to drop all spectral results below 70 Hz from consideration. FIG. 14 shows four groups of mean frequencies in ascending order, measured from the distinct circuits that FIG. 13 can produce. Group A are the single-coil humbucking doubles, numbering 12, extending from 540 to 654 Hz. Group B are the single-coil humbucking triples, numbering 24, extending from 532 to 886 Hz. Group C are the dual-coil humbucking singles, doubles and triples, numbering 12, extending from 506 to 1009 Hz. Group D are the non-humbucking single-coil singles, pairs and triples, numbering 18, extending from 562 to 1080 Hz. The strongest outputs are the warmest, and bunch together at the warm end. The weakest outputs are the brightest and spread out more at that end. It has yet to be determined how these presumed 66 tones will be perceived by musicians.

This embodiment represents the current limits of what a mechanical common-point pickup switching system can do, with switches and controls which can fit under the soundboard or pickguard of a standard-sized electric guitar. With a digitally-controlled solid-state analog common point switching system (U.S. Pat. No. 10,380,986, Baker, 2019), 6 coils can produce 301 humbucking doubles, triples, quads, quints and hexes, ignoring whatever non-humbucking circuits can be produced by shorting the common point to one of the outputs (preferably the ground). But presumably it still beats a 3-way or 5-way switch.

Embodiment 5: Embodiment 1, Using the $4^{th}$ Pole of a 4P6T Circuit Switch for Signal Strength Correction The embodiments presented above all use a 3P6T switch to produce 6 different pickup circuits, when most such switches are actually 4P6T, and 6P6T switches are more expensive, but available. U.S. Pat. No. 10,380,986 effectively covers the use of the $4^{th}$ pole as gain or tone correction in FIGS. 7, 8, 10 and 11; shows a 6PXT switch for all 6 coils of 3 humbuckers in FIG. 12; and shows a 6P6T switch used for both gain and tone correction in FIG. 13. U.S. Pat. No. 10,217,450 shows the $4^{th}$ pole used for gain correction in FIG. 17, and shows concatenated switches in FIGS. 16 & 19.

Figure 15:
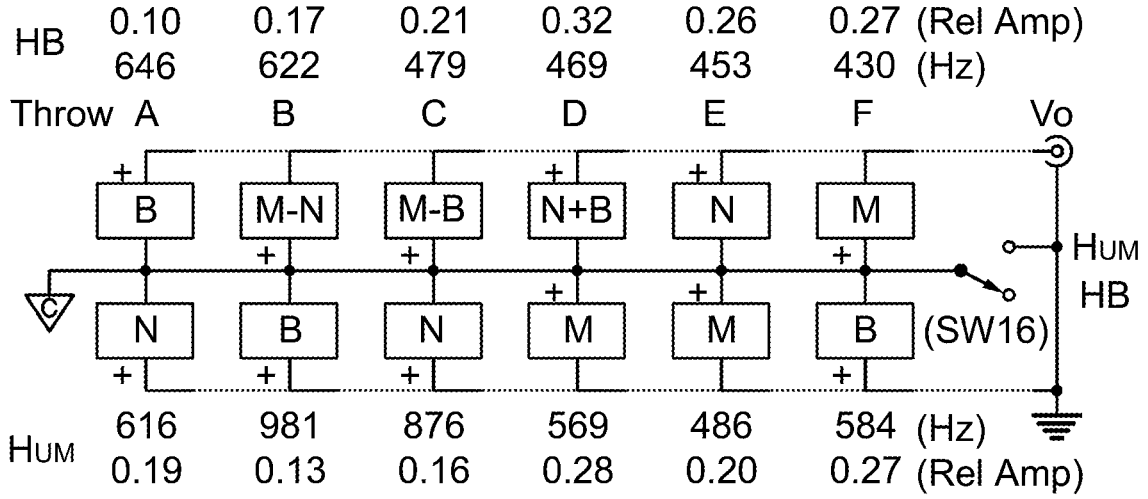
FIG. 15 shows the pickup circuits from Embodiment 1, reordered for Embodiment 4, with one pole of the mode switch, SW16 from FIG. 16, to choose whether the common-point connection (C-triangle) is grounded ($H_{UM}$) to produce all non-humbucking circuits at the output (Vo), or left open (HB) to produce all humbucking circuits. In this setup, the throws of SW15 from FIG. 16 are connected to produce humbucking circuits of decreasing mean frequency from Throws A to F. The measured relative spectral amplitude (Rel Amp) and mean frequencies (Hz) of the humbucking circuits (HB) are shown above the switch selections, and those for the non-humbucking circuits ($H_{UM}$) are shown below. The signs of the pickup combinations are shown, with the ½ factor left off of the pairs above the common-point connection line.
Figure 16:
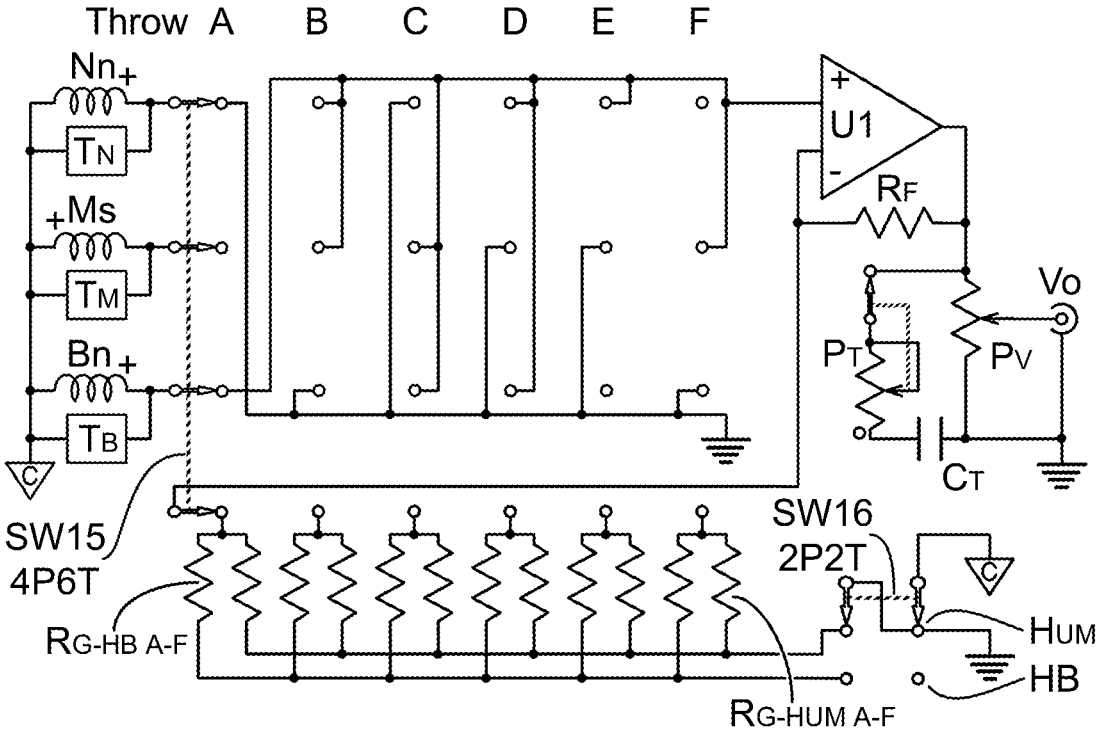
FIG. 16 shows the circuit from FIG. 6, modified: 1) to change the order of circuit switching by SW15; 2) to use the $4^{th}$ pole of a 4P6T circuit switch, SW15, to change gain resistors, $R_{G\text{-}HB\ A\text{-}F}$ and $R_{G\text{-}HUM\ A\text{-}F}$, in a preamplifier circuit, using U1, to equalize pickup circuit signals at the output, Vo; 3) to use the 2nd pole of the mode switch, SW16, to choose the set of resistors to use in gain correction; 4) using a single tone capacitor, $C_T$, before the output; and 5) to use individual pot-capacitor tone circuits, $T_N$, $T_M$, $T_B$, on the pickups, Nn (neck, N-up), Ms (middle, S-up), Bn (bridge, N-up), as in U.S. Pat. No. 10,380,986 (Baker, 2019) FIGS. 9-11.

FIG. 15 shows the pickup circuits from Embodiment 1, reordered for Embodiment 4, with one pole of the mode switch, SW16 from FIG. 16, to choose whether the common-point connection (C-triangle) is grounded ($H_{UM}$) to produce all non-humbucking circuits at the output (Vo), or left open (HB) to produce all humbucking circuits. In this setup, the throws of SW15 from FIG. 16 are connected to produce humbucking circuits of decreasing mean frequency from Throws A to F. The measured relative spectral amplitude (Rel Amp) and mean frequencies (Hz) of the humbucking circuits (HB) are shown above the switch selections, and those for the non-humbucking circuits ($H_{UM}$) are shown below. The signs of the pickup combinations are shown, with the ½ factor left off of the pairs above the common-point connection line.

FIG. 16 shows the circuit from FIG. 6, modified: 1) to change the order of circuit switching by SW15; 2) to use the $4^{th}$ pole of a 4P6T circuit switch, SW15, to change gain resistors, $R_{G\text{-}HB\ A\text{-}F}$ and $R_{G\text{-}HUM\ A\text{-}F}$, in a preamplifier circuit, using op-amp U1, to equalize pickup circuit signals at the output, Vo; 3) to use the 2nd pole of the mode switch, SW16, to choose the set of resistors to use in gain correction; 4) using a single tone capacitor, $C_T$, before the output; and 5) to use individual pot-capacitor tone circuits, $T_N$, $T_M$, $T_B$, on the pickups, Nn (neck, N-up), Ms (middle, S-up), Bn (bridge, N-up), as in U.S. Pat. No. 10,380,986 (Baker, 2019) FIGS. 9-11.

The resistors for humbucking pickup circuits, $R_{G\text{-}BB\ A\text{-}F}$, are all on the left of the resistor pairs connected to the poles of SW15. The resistors for non-humbucking pickup circuits, $R_{G\text{-}HUM\ A\text{-}F}$, all on the right. The gain of the amplifier made with U1 is $Vo/Vi=Gx=(R_F+R_{GX})/R_{GX}$, where Vi is the output of SW15. The gain is always greater than 1. The relative signal amplitudes of the pickup circuits run from 0.10 to 0.32. Say that Gmin=1.1 for a signal level of 0.32, and we want all the outputs to have the same level, Vomax. Then for each switch output signal Vix, $R_{GX}=Vix*R_F/(Vomax-Vix)$. For Vix=0.32, $R_{GX}=10*R_F$, and Vomax=0.352. So for Vix=0.10, $R_{GX}=0.397*R_F$, and Vo=0.352. These $R_{GX}$ values are not likely to be common 10% resistor values, so either small multi-turn pots or resistors of higher precision will be needed. And these results can change with the distance between the poles and the strings.

The op-amp circuit isolates the output tone capacitor, $C_T$, from the pickups, so that it cannot form any resonant peaks with the lumped circuit inductance. Therefore, if that high-frequency peaking effect is desired for tone, peaking capacitors and pots must be connected to the pickups individually, as shown by $T_N$, $T_M$ and $T_B$ in FIG. 16, and similar circuits if FIGS. 9-11 of U.S. Pat. No. 10,380,986. The preferred embodiment would be either having the tone circuits mounted on the pickups, with the pot accessible above the pickguard or soundboard, or mounting them next to the pickups on the guitar. Mini-pots with a very low-profile slotted shafts and integral off switches would be preferable. While it needs more study, this modification to the sensors/pickups which provides high-frequency peaking, even without the presence of an amplifier between the circuit connection switch and the system output, could be the means to separating tones where they bunch in the warm end. It would certainly offer to musicians more individual tonal variation between instruments of the same manufacture.

I claim:

1. A sensor switching system for a musical instrument, comprised of:

a. two or more matched vibration sensors, with two or more terminals, matched to produce the same signal outputs to the same inputs of external interference, also known as hum, and having one of two polarities, such that said vibration signal can be made or arranged to present either normal or opposite polarity, with respect to another of said matched sensors when placed in the same physical position; and b. a common connection point, to which all of all of said sensors are connected by their terminals which have the same hum phase; and c. a switching system, which i. is comprised of:

1. a sensor circuit connection switch of multiple poles and multiple throws, which:

a. creates circuits of two or more of said sensors to produce output signals in which hum is cancelled, also known as humbucking, by connecting at least one sensor to the high signal output and at least one sensor to the low signal output, in which if said low signal output is also the ground of a single-ended output pair, said common point is grounded only to create different modes of output; and b. may create circuits of one or more passive components to modify said output signals; and 2. one or more mode switches, each of at least one pole and at least two throws, used to change the effective operation of said circuit connection switch and output signals, including:

a. to choose whether to short said common-point connection to the low output terminal of said switching system, so as to use only the sensors connected between it and the high output terminal of said switching system; and b. to choose which of said sensor terminals to connect to said sensor connection switch; and c. to choose which of said sensor terminals to connect to said common-point connection; and ii. connects at least one of said sensors, by a terminal of said sensor not connected to said common point, to said high output terminal; and iii. connects at least one of another of said sensors, by a terminal of said sensor not connected to said common point, to said low output terminal; and iv. connects the system reference ground to either said common connection point or said low output terminal, but not both in normal operation, except for cases of circuit testing and additional modes of operation; and d. other conventional circuits of ordinary design, connected between the output of said circuit connection switch and the system output, for the purposes of ordinary signal modification.

2. An embodiment of said switching system as recited in claim 1, wherein:

a. said sensors are comprised of three matched single-coil electromagnetic guitar pickups, and b. there is one said mode switch which has 2 poles and 2 throws, of which:

i. one pole either shorts said common point to said low output terminal, commonly the system ground, or does not, and ii. one pole chooses one of 2 tone capacitors for a standard tone pot, and c. said circuit connection switch has at least 3 poles and at least 5 throws, and at each throw connects 1 or more of said matched pickups to said high output terminal, and only 1 of any of the remaining of said pickups to said grounded or low output terminal, so that when said mode switch connects said common point to said grounded or low output terminal, only that one pickup is shorted out.

3. An embodiment of said switching system as recited in claim 1, wherein:

a. said sensors are comprised of three matched single-coil electromagnetic guitar pickups, with 2 pickups having the same magnetic poles toward the strings of said instrument, the instrument being a stringed instrument, and the 3$^{rd}$ pickup, having the opposite magnetic pole towards said strings, commonly but not necessarily placed in the middle position, between the pickup closest to the neck of said instrument and the pickup closest to the bridge of said instrument, and b. there is one said mode switch which has 4 poles and 2 throws, of which:

i. one pole either shorts said common point to said low output terminal or said ground of said circuit connection switch or does not, and ii. one pole chooses one of 2 tone capacitors for a standard tone pot, and iii. two poles reverse the connections of said 3rd pickup to said connection switch, such that when the mode switch shorts said common point to said ground, said pickup pairs involving said 3$^{rd}$ pickup connected to between said ground and said output are all humbucking, and c. said circuit connection switch has at least 3 poles and at least 5 throws, and at each throw connects 1 or more of said matched pickups to said high output terminal, and only 1 of any of the remaining of said pickups to said grounded or low output terminal, so that when said mode switch connects said common point to said grounded or low output terminal, only that one pickup is shorted out and d. when said mode switch is in said common-point shorting position, the order of the first five of said pickup singles and pairs chosen by said connection switch duplicates the pickup switching order of a common 5-way guitar switch, namely, bridge, bridge plus middle, middle, middle plus neck, and neck, the last ordered position being neck plus bridge, if said circuit connection switch has 6 poles.

4. An embodiment of said switching system as recited in claim 1, wherein:

a. said sensors are comprised of three dual-coil humbucking electromagnetic guitar pickups, with 2-wire outputs, and b. there is one said mode switch which has 2 poles and 2 throws, of which:

i. one pole either shorts said common point to said ground or does not, and ii. one pole chooses one of 2 tone capacitors for a standard tone pot, and c. said circuit connection switch has at least 3 poles and at least 5 throws, and: and at each throw connects 1 or more of said pickups to said high output terminal, and only 1 of any of the remaining of said pickups to said grounded or low output terminal, so that when said mode switch connects said common point to said grounded or low output terminal, only that one pickup is shorted out.

5. An embodiment of said switching system as recited in claim 1, wherein:

a. said sensors are comprised of three dual-coil humbucking electromagnetic guitar pickups, in which each pickup has one coil with a North magnetic pole towards the strings of said instrument, the instrument being a string instrument, and the other coil has a South magnetic pole towards said strings, and said coils are matched in response to external hum, and said coils are connected in series, with the connection between them available as a center-tap output to the rest of the circuit, making each pickup a 3-wire device, and b. has 5 mode switches, of which:

i. one has 2 poles and 2 throws, and 1. one pole either shorts said common point to said low output terminal or said ground or does not, and 2. one pole connects 1 of 2 tone capacitors to a tone pot, and ii. one has 6 poles and 2 throws, said throws being associated with single-coil and dual-coil modes, and 1. three of said poles connect either said common-point to said center taps of said dual coil pickups in said single-coil position, or connect said common point to the nominally low output terminal coil of each said dual-coil pickups to said common point in said dual-coil position, and 2. the other three of said poles either connect 3 said poles of said connection switch to three 1P2T mode switches in said single-coil position, or connect the same 3 said poles of said connection switch to the nominally high output terminal of the same of each said dual coil pickups in said dual-coil position, and iii. three are said 1P2T switches, the poles of which each connect as said above to one throw of said three poles connected to said 6P2T mode switch, and the 2 throws of each of said 1P2T connect individually to either:

a. said nominally high output coil of each of said dual-coil pickups, which will be either said north or south pole coil for all said pickups or b. said nominally low output coil of each of said dual coil pickups, which will be the remaining said pole coil for all said pickups, and c. said circuit connection switch has at least 3 poles and at least 5 throws, and through said mode switches each throw connects 1 or more of said pickups or said coils to said high output terminal, and only 1 of any of the remaining of said pickups or said coils to said grounded or low output terminal, so that when said mode switch connects said common point to said grounded or low output terminal, only that one pickup is shorted out.

6. Said switching system as recited in claim 1, wherein an otherwise unused pole of said circuit connection switch, and one or more poles or throws of said mode switches, are used to modify the output signal of said switching system, wherein there can be 1 or more of said circuit elements connected to each of said circuit connection switch throws, and each of said circuit elements can be connected to 1 or more of said circuit connection switch throws.

7. Said switching system as recited in claim 1, wherein tone circuits to are connected individually to one or more of said sensors, said individual tone circuits being comprised of:

a. a fixed reactive element, such as an inductor or capacitor, and b. a resistive element, preferably variable, connected:

i. in series with said reactive element, if said tone circuit is connected in parallel with said sensor, or ii. in parallel with said reactive element, if said tone circuit is connected in series with said sensor, and c. a means of disabling each said tone circuit connected to each associated said sensor, such as a separate switch or a replaceable shorting link or an integral switch in said resistive element, which is:

i. in series with said tone circuit, if it is in parallel with said sensor, or ii. in parallel with said tone circuit, if it is in series with said sensor.

* * * * *